United States Patent [19]

Adair et al.

[11] Patent Number: 4,476,213

[45] Date of Patent: Oct. 9, 1984

[54] NON-AQUEOUS SILVER HALIDE DIFFUSION IMAGING SYSTEM

[75] Inventors: Paul C. Adair; Amy L. Burkholder; Homer G. Duda; Richard F. Wright, all of Chillicothe; Mary M. Stanley, Waverly, all of Ohio

[73] Assignee: The Mead Corporation, Dayton, Ohio

[21] Appl. No.: 448,633

[22] Filed: Dec. 10, 1982

[51] Int. Cl.[3] ..... G03C 5/54

[52] U.S. Cl. ..... 430/229; 430/230; 430/246; 430/249

[58] Field of Search ..... 430/227, 229, 230, 206, 430/244, 246, 249

[56] References Cited

U.S. PATENT DOCUMENTS

| | | | |
|---|---|---|---|
| 2,376,371 | 5/1945 | Lowe | 117/34 |
| 2,543,181 | 2/1951 | Land | 95/8 |
| 2,861,885 | 11/1958 | Land | 96/29 |
| 2,882,151 | 4/1959 | Yutzy et al. | 430/206 |
| 3,162,534 | 12/1964 | Powers | 96/66 |
| 3,348,946 | 10/1967 | Jones | 96/29 |
| 3,438,776 | 4/1969 | Yudelson | 430/230 |
| 3,576,628 | 4/1971 | Beavers | 430/230 |
| 3,976,489 | 8/1976 | Levy | 430/230 |
| 3,985,561 | 10/1976 | DeHaes et al. | 430/230 |

FOREIGN PATENT DOCUMENTS

| | | | |
|---|---|---|---|
| 482332 | 4/1952 | Canada . | |
| 708554 | 4/1965 | Canada | 96/62 |
| 1182302 | 2/1970 | United Kingdom . | |
| 1182306 | 2/1970 | United Kingdom . | |

OTHER PUBLICATIONS

Rott and Weyde, *Photographic Silver Halide Diffusion Processes,* pp. 140–144.

*Primary Examiner*—Richard L. Schilling

*Attorney, Agent, or Firm*—Arnold, White & Durkee

[57] ABSTRACT

A self-contained silver halide diffusion transfer imaging sheet is provided which contains three layers on a substrate. The first layer is a silver halide emulsion formed in a non-ionic material. The intermediate layer is a water barrier. The third layer is a nucleating region which contains colloidal silver. A developer, base and silver transport agent can also be located in these layers. For example, the base and silver transport agent can be located in the nucleating layer, with the developer located in the emulsion layer. After the emulsion is exposed to actinic radiation, a non-aqueous activating medium is supplied which initiates the development and diffusion transfer processes. The final result is a positive image in the nucleating layer.

14 Claims, 2 Drawing Figures

NON-AQUEOUS SILVER HALIDE DIFFUSION IMAGING SYSTEM

BACKGROUND OF THE INVENTION

The present invention relates to silver halide imaging, and more particularly, to means and methods of silver halide imaging in diffusion transfer systems.

There are many imaging systems which employ silver halide emulsions as their photosensitive component. The emulsion is usually a suspension of microscopic silver halide grains in a continuous phase, such as gelatin. When the silver halide emulsion is exposed to actinic radiation, a chemical change occurs in the exposed silver halide grains that facilitates their reduction to metallic silver by a developer. ("Actinic radiation" as used in this specification and the appended claims means the entire spectrum of electromagnetic radiation.) This change in the exposed silver halide grains is known as a latent image. It is generally believed that the latent image consists of colloidal particles of silver, each containing several silver atoms, which are located primarily at the surface of exposed silver halide grains. (Colloidal particles are generally defined as having at least one dimension between about 1 nanometer and 1 micron.)

The number of changed, i.e. developable, grains in any small area of the emulsion depends on the intensity of the light exposure of that area. When a developer is applied, the chemical reduction of the exposed grains occurs. Therefore, after development, there is an image which is a silver deposit in the emulsion, and whose density varies across the surface of the emulsion in a pattern that corresponds to the image that was exposed on it.

The next step commonly employed in processing silver halide emulsion-type film is fixing, which removes the remaining unreduced grains to prevent their later darkening. The image that results from this process is negative, and a positive image is usually produced from it through contact printing or projection.

One alternative process for producing positive images is referred to as diffusion transfer. In this process a negative silver halide film is exposed to actinic radiation as described above. Typically, development is completed in an aqueous monobath which contains a developer, a strong base to aid in development, a silver transport agent, and a solvent. The transport agent and solvent dissolve the grains of silver halide in unexposed areas, some of the grains in lightly exposed areas, and almost no grains in highly exposed areas. The grains that are not dissolved are the ones that have been or are being reduced to metallic silver by the developer. The dissolved silver halide diffuses from the emulsion to a receiving or nucleating sheet superimposed on the transfer sheet. Alternatively, the nucleating area may be a separate layer on the same substrate as the silver halide emulsion.

The nucleating sheet or layer contains colloidal silver, which catalyzes the reduction of the dissolved silver halide to metallic silver. As a result, silver deposits form across the nucleating area in inverse proportion to the intensity of exposure of the corresponding area on the silver halide emulsion. Thus, a positive image is formed in the nucleating layer.

Attempts to include the developer, base and silver transport agent in a single, self-contained diffusion transfer sheet that can be activated by application of a solvent alone have met with a number of problems.

Some of these three materials are incompatible with one another. For example, the base must be kept separate from the developer. If it is not kept separate, the developer will readily oxidize, thus substantially reducing the shelf life of the diffusion transfer sheet. Also, the silver transport agent must be separate from the silver halide emulsion in order to prevent premature silver dissolution.

The obvious expedient of coating these materials onto a single substrate as separate layers has not been shown to be entirely technically and commercially unsatisfactory. Some mixing inevitably occurs during coating, and absorbed atmospheric water causes the water soluble components to migrate. Therefore, no answer has apparently been found in the past to the problems of making a self-contained diffusion transfer sheet. This problem has limited the scope of diffusion transfer imaging's usefulness, since in some applications the complexity of a two-sheet system or applying the developing reagents from an external source presents a major difficulty. There has been a long felt need in the photographic and photocopy industries for products and processes which avoid or minimize the problems described above.

Another problem with prior art diffusion transfer systems involves the emulsion composition. The silver halide emulsion is commonly formed with gelatin, a highly ionic material, as the continuous phase. The use of gelatin limits the types of solvents that are satisfactory, because most non-aqueous solvents are insufficiently polar to overcome the attraction of the ionic silver grains to gelatin. Therefore, when gelatin is used with a non-aqueous solvent, little silver transport occurs.

U.S. Pat. No. 3,348,946 to Jones is an example of method and means for diffusion transfer imaging. A developer is incorporated in a silver halide emulsion on a substrate. A developing solution containing a polyhydric alcohol, a base and a silver halide stabilizing agent is applied to the emulsion sheet after exposure. Normally the developing solution is incorporated into a separate, image receiving sheet, which is superimposed on the emulsion sheet during development, and in which the positive image is ultimately produced.

Two other patents in the area of diffusion transfer imaging systems are British Pat. Nos. 1,182,302 and 1,182,306 to Land et al. These patents disclose multilayer diffusion transfer sheets which include a substrate, a light-sensitive layer and a translucent layer. The sheets disclosed can also contain a silver receptive stratum and processing reagents. The translucent layer and light-sensitive layer can be combined as an alternative embodiment.

In the disclosure of these patents, an aqueous medium is used to dissolve and/or apply the processing reagents (developer, base, etc.). The light-sensitive layer is taught to comprise a silver halide emulsion with gelatin as its continuous phase.

The translucent layer blocks a high enough percentage of incident light that it prevents premature exposure of the silver halide emulsion, and also provides a background for viewing the positive image that is ultimately formed in the silver-receptive stratum. However, it permits enough light to pass so that exposure of the silver halide emulsion is not appreciably retarded when an exposure light source is used.

SUMMARY OF THE INVENTION

A silver halide diffusion transfer system in accordance with the present invention can be a multi-layer, self-contained sheet which has an intermediate layer that acts as a water barrier. Such a sheet will operate to produce positive images through diffusion transfer without suffering from the problems of material incompatibility and restricted solvent selection discussed above. The various incompatible components can be kept separate from each other within a single sheet. A non-aqueous medium is used to initiate the development and diffusion mechanisms, since an aqueous medium could not penetrate the intermediate layer.

Thus, as a practical matter, one-piece sheets in accordance with the present invention make diffusion transfer imaging feasible for additional applications, especially those in which the complexity of using a second sheet or external reagent application presents a major difficulty.

A diffusion transfer sheet in accordance with the present invention comprises a substrate, a silver halide emulsion layer, a nucleating layer, which will usually be the layer farthest from the substrate, and means for separating the silver halide emulsion layer and the nucleating layer which acts as a water barrier. The means for separating can be a distinct, intermediate layer. Alternatively, it can be material in the emulsion and/or nucleating layers themselves which will effectively act as a water barrier between the components of those two layers. In either case, this means will usually also include an opacifying agent.

The term "sheet" is used herein to refer to a multilayer article as described above. It is intended, both in this specification and the appended claims, to include articles formed on a substrate which is flat, such as a sheet of paper, as well as rolls, wheels, and other well-known substrates.

The sheet can further include a developer and a base, which are on opposite sides of the intermediate layer. A silver transport agent can also be included in the sheet within the nucleating layer, and thus separated from the silver halide grains. The opacifying agent in the intermediate layer prevents premature exposure of the emulsion. Polyvinyl alcohol and a nonpolar diluent can also be included in the emulsion layer.

Alternatively, the developer, base and silver transport agent, or any combination of them, can be left out of the diffusion transfer sheet itself and instead supplied with the non-aqueous activating medium. However, this variation of the diffusion transfer sheet is not self-contained to the extent that the one described in the paragraphs above is, and thus it is less advantageous.

The imaging mechanism in the present invention begins with exposure of the silver halide emulsion to actinic radiation to form a latent image. Exposure can be from either side of the sheet. A non-aqueous medium is applied to the sheet, dissolving the developer, base and silver transport agent located in the sheet. The resulting solution diffuses throughout the sheet. The developer reduces the exposed grains to metallic silver. The unreduced silver halide grains are dissolved and diffuse from the emulsion layer to the nucleating layer by means of the non-aqueous medium and silver transport agent.

The collodial silver present in the nucleating layer catalyzes the reduction of the dissolved silver halide. The end result is a positive image in the nucleating layer. The negative image formed in the emulsion layer is hidden from view by the opacifying agent in the intermediate layer.

The present invention solves the problems of the prior art in making a self-contained diffusion transfer sheet. Since only a non-aqueous medium must be added to the sheet to initiate the processing of a latent image, a sheet in accordance with the present invention will be very useful in a number of imaging applications, such as office copying.

Further, the emulsion composition of the present invention permits the use of non-aqueous solvents, which were largely unsuccessful in prior art systems.

DESCRIPTION OF SPECIFIC EMBODIMENTS

Figure 1:
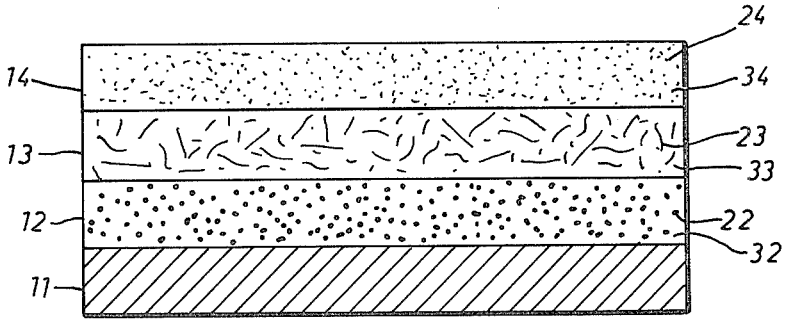
FIG. 1 is a schematic representation of a multilayer diffusion transfer sheet in accordance with the present invention.

A diffusion transfer sheet in accordance with the present invention, as shown in FIG. 1, has three layers coated on a substrate 11: an emulsion layer 12, an intermediate layer 13 and a nucleating layer 14.

FIG. 1 shows a diffusion transfer sheet formed on a flat substrate 11. However, as noted above, substrates having other shapes, such as rolls, are also possible. The substrate 11 can suitably consist of a fibrous material, a polymeric material such as plastic, or other materials whose chemical properties and strength make them compatible with this environment. Gilclear paper has been found to be a suitable substrate.

Figure 2:
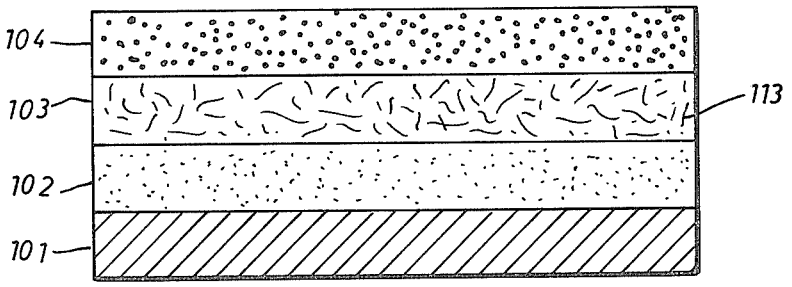
FIG. 2 is a schematic representation of a multilayer diffusion transfer sheet in accordance with the present invention, whose nucleating layer and silver halide emulsion layer are inverted from their position in FIG. 1.

The remainder of this description will concern a diffusion transfer sheet which employs an opaque substrate. However, a transparent substrate can be used in an alternative embodiment as shown in FIG. 2. In that embodiment, the nucleating layer 102 is usually the layer closest to the substrate 101. On top of the nucleating layer 102 is the intermediate layer 103, which contains an opacifying agent 113. The next layer is the silver halide emulsion layer 104. In this embodiment, the emulsion can be exposed from either side, but the positive image formed in the nucleating layer 102 will be viewed through the transparent substrate 101.

Referring once against to FIG. 1, the emulsion layer 12, which will usually be the layer closest to the substrate 11, contains silver halide grains 22 in a continuous phase 32. The silver halide grains 22 are the photosensitive component of the system. The continuous phase 32 must be composed of a material which is compatible with the rest of the system. Since the intermediate layer 13 acts as a water barrier, a non-aqueous medium will be used to activate the sheet. Thus, the continuous phase 32 must be compatible with non-aqueous solutions. This constraint presents a problem, since gelatin, the material most commonly used for the continuous phase in the past, is highly ionic. Most non-aqueous solvents are not polar enough to overcome the attraction of the ionic silver complexes to the gelatin, which is itself ionic. Therefore, the continuous phase must be primarily made from another material.

One suitable replacement for gelatin in the emulsion layer is polyvinylalcohol. A silver halide emulsion with polyvinylalcohol as a component of its continuous phase 32 is compatible with non-aqueous solvents. The emulsion can be diluted with a nonpolar polymer, such as latex. (The nonpolar polymer does not act as a gelatin substitute; it serves to dilute the polyvinylalcohol.) The use of such a nonpolar diluent has been found to aid silver transport and increase the sheet's permeability to non-aqueous solvents. UCAR Vehicle 4431X is one acrylic latex that has been found suitable for this use. (UCAR is a registered trademark of Union Carbide Corporation.)

The intermediate layer 13 functions as a water barrier. It is therefore essential that the substance used as a continuous phase 33 in the intermediate layer 13 be impermeable to water but permeable to the non-aqueous activating medium. Although a variety of chemicals and compounds are readily available that satisfy these essential characteristics, UCAR latex has shown exceptional utility.

The intermediate layer 13 should additionally contain an opacifying agent 23 to prevent the emulsion from being prematurely exposed to actinic radiation. Titania is a satisfactory opacifying agent. Other opacifying agents are well known in the photographic arts and can be used in the product and process of this invention.

The nucleating layer 14 contains collodial silver particles 24. The silver 24 should be dispersed in a material 34 that is not permeable to water but is permeable to non-aqueous solvents. UCAR latex has been found suitable for this use as well.

A multi-layer sheet constructed as described above can also contain a developer, a base to facilitate developing, a silver transport agent and a toning agent. (Toning agents are well known in the silver halide imaging industry and are frequently used to obtain a darker image. An example of a suitable toning agent is methylbenzotrizole.) As discussed previously, the developer and base must be kept separate in order to prevent oxidation of the developer. Further, the silver transport agent must be separate from the silver halide emulsion or premature silver dissolution would occur. One arrangement that would satisfy these constraints would include the base, the toning agent and the silver transport agent in the nucleating layer 14 and the developer in the emulsion layer 12. The intermediate layer 13, because of its impermeability to water, would prevent the mixing of these reagents until the non-aqueous activating medium is applied.

The non-aqueous activating medium will contain a polar, non-aqueous solvent, such as ethylacetate, p-dioxane, methanol, ethanol or diglycol methyl ether. When applied to a multi-layer sheet that has been exposed to actinic radiation, the medium will dissolve the reagents contained therein and permit their diffusion throughout the sheet, thus beginning the development and silver transport processes. The presence of alcohols in the activating medium seems to improve the overall imaging process.

Methods of applying an activating medium are well-known in the art. One example is moving a saturated wiper across the sheet.

Suitable bases include triethanolamine, diethylenetriamine and ethanolamine. Silver transport agents known to work in the present invention usually contain amino or sulfur groups. Examples include adamantanamine, thiourea and 2-2'-dipyridylamine.

Several experiments are illustrative of the invention described herein. These examples are provided by way of illustration only and are not intended to limit the scope of the invention.

EXAMPLE 1

A multi-layer diffusion transfer sheet was constructed as follows. The nucleating layer consisted of colloidal silver in UCAR 4431 latex. Each square foot of this layer contained about one milligram of colloidal silver. The intermediate layer was a mixture of titania and UCAR 4431 latex. Thirty grams of titania, 20 milliliters of latex and 75 milliliters of water were mixed to create a layer that contained about 1.5 grams of titania per square foot. The emulsion layer contained silver chloride grains. The emulsion consisted of 68% silver, 5.08% polyvinyl alcohol, and was diluted by an equal volume of UCAR 4431 latex.

The sheet was exposed emulsion side up through a mask by a hand-held ultraviolet lamp. It was developed by a solution containing 100 milliliters of ethylacetate, 10 milliliters of triethanolamine and one gram of phenidone. After developing, a silver transport agent in a non-aqueous medium was applied with a saturated wiper. The silver transport agent was 2, 2'-dipyridylamine, which was present at a concentration of 0.1 M in 10 milliliters of methanol and 90 milliliters of diglycol methyl ether (diglyme). Other transport agents tested for this use are adamantanamine and thiourea.

After the non-aqueous silver transport medium was applied, silver was transported to the nucleating layer, and a positive image was formed.

EXAMPLE 2

This test illustrates the result of developing a gelatin based emulsion with a non-aqueous solvent. A silver chloride emulsion was prepared in gelatin containing a phenidone developer, and was coated on a paper substrate. It was exposed through a mask and developed with a 10% solution of diethylenetriamine in ethylacetate. The resulting image showed a maximum density of 0.5 and a minimum density of 0.4.

EXAMPLE 3

This test illustrates the results of developing a non-gelatin based emulsion with a non-aqueous solvent. A highly oleophilic silver halide emulsion was prepared containing UCAR 4431 latex and a minimum of gelatin. When coated on a substrate, this mixture showed substantially greater permeability to organic solvents than in the gelatin only emulsions.

The sheet was exposed and then developed in a p-dioxane solution containing about 1% phenidone and 5% ethanolamine. The image appeared in 1 to 2 seconds, and was fixed in a standard aqueous bath. Maximum and minimum density values of 0.45 and 0.08 were observed in the image.

EXAMPLE 4

This example illustrates the inclusion of all reagents into the diffusion transfer sheet, so that only a non-aqueous activating medium need be applied.

A silver halide emulsion was made in 8% polyvinyl alcohol and then diluted with UCAR latex and 8% polyvinyl alcohol in a ratio of 1:2:1. One gram of phenidone (the developer) per 10 grams of this mixture was added. The resulting emulsion was coated on Gilclear paper.

The intermediate layer was formed with Rohm & Haas Rhplex P-57 whose pH had been raised to 9.5 by the addition of $NH_4OH$. Twenty percent (by weight) NuClay, 25% Unitane titanium dioxide and a small quantity of water were added, and the mixture was then coated on top of the emulsion layer.

The colloidal silver for the nucleating layer was made with silver nitrate and tannic acid in water, and then was diluted 50% with UCAR latex. To this mixture was added a KOH solution to increase the pH to 13.8, 4% by weight adamantanamine (the silver transport agent) and 10% by weight methylbenzotriazole (the toning agent). This mixture was coated on top of the intermediate layer.

The sheet was exposed, and then the development and silver transport processes were initiated by applying a 10% solution of ethanol in diglyme.

The preceding examples illustrate the use of specific embodiments of the present invention. These examples and the other discussion are intended to be illustrative. Those skilled in the art will appreciate that some modifications could be made which would remain within the scope and spirit of the invention.

What is claimed is:

1. A diffusion transfer imaging sheet, comprising:

a substrate;

a silver halide emulsion layer which includes a continuous phase that is nonionic;

a nucleating layer; and means for separating the silver halide emulsion layer and nucleating layer which act as a water barrier and which are permeable to non-aqueous solutions.

2. The diffusion transfer imaging sheet of claim 1, wherein the means for separating are an intermediate layer which is located between the silver halide emulsion layer and the nucleating layer and which includes an opacifying agent.

3. The diffusion transfer imaging sheet of claim 2, further comprising a developer on one side of the intermediate layer.

4. The diffusion transfer imaging sheet of claim 3, further comprising a base which is on the opposite side of the intermediate layer from the developer.

5. The diffusion transfer imaging sheet of claim 4, further comprising a silver transport agent in the nucleating layer.

6. The diffusion transfer imaging sheet of claim 5, further comprising a toning agent in the nucleating layer.

7. The diffusion transfer imaging sheet of claim 5, wherein the developer is phenidone.

8. The diffusion transfer imaging sheet of claim 5, wherein the base is selected from the group consisting of triethanolamine, diethylenetriamine, and ethanolamine.

9. The diffusion transfer imaging sheet of claim 5, wherein the silver transport agent is selected from the group consisting of adamantanamine, thiourea, and 2,2′-dipyridylamine.

10. The diffusion transfer imaging sheet of claim 2, wherein the continuous phase of the silver halide emulsion layer comprises polyvinylalcohol.

11. The diffusion transfer imaging sheet of claim 10, further comprising a non-polar diluent in the silver halide emulsion layer.

12. The diffusion transfer imaging sheet of claim 11, wherein the non-polar diluent is latex.

13. The diffusion transfer imaging sheet of claim 12, wherein the opacifying agent is titania.

14. A diffusion transfer imaging sheet, comprising:

substrate;

a silver halide emulsion layer which includes a developer, a continuous phase which is nonionic and contains a non-polar diluent;

an intermediate layer which is interposed between the silver halide emulsion layer and nucleating layer, acts as a water barrier, includes an opacifying agent, and is permeable to non-aqueous solutions;

a nucleating layer which includes colloidal silver particles, a base, a silver transport agent and a toning agent.

* * * * *